US011329440B2

(12) United States Patent
Della Torre et al.

(10) Patent No.: US 11,329,440 B2
(45) Date of Patent: May 10, 2022

(54) CRIMPING TOOL EXCHANGE DEVICE

(71) Applicant: KOMAX HOLDING AG, Dierikon (CH)

(72) Inventors: Marco Della Torre, Sachseln (CH); Stefan Viviroli, Horw (CH)

(73) Assignee: KOMAX HOLDING AG, Dierikon (CH)

( * ) Notice: Subject to any disclaimer, the term of this patent is extended or adjusted under 35 U.S.C. 154(b) by 435 days.

(21) Appl. No.: 16/044,607

(22) Filed: Jul. 25, 2018

(65) Prior Publication Data

US 2019/0036288 A1 Jan. 31, 2019

(30) Foreign Application Priority Data

Jul. 25, 2017 (EP) ..... 17182955

(51) Int. Cl.

| | |
|---|---|
| ***H01R 43/055*** | (2006.01) |
| ***H01R 43/04*** | (2006.01) |
| *H01R 43/048* | (2006.01) |
| *H01R 43/052* | (2006.01) |

(52) U.S. Cl.

CPC ..... *H01R 43/055* (2013.01); *H01R 43/04* (2013.01); *H01R 43/048* (2013.01); *H01R 43/0488* (2013.01); *H01R 43/052* (2013.01); *Y10T 29/49218* (2015.01); *Y10T 29/49222* (2015.01); *Y10T 29/53213* (2015.01); *Y10T 29/53235* (2015.01)

(58) Field of Classification Search

CPC ..... H01R 43/048; H01R 43/0488; H01R 43/052; H01R 43/055; H01R 43/04; Y10T 29/53213; Y10T 29/53235; Y10T 29/49218; Y10T 29/49222

See application file for complete search history.

(56) References Cited

U.S. PATENT DOCUMENTS

| | | | | |
|---|---|---|---|---|
| 6,961,992 | B2 * | 11/2005 | Conte | H01R 43/048 29/33 M |
| 2010/0071203 | A1 * | 3/2010 | Blickenstorfer | H01R 43/048 29/753 |
| 2014/0150260 | A1 * | 6/2014 | Fischer | Y10T 29/53235 29/862 |

FOREIGN PATENT DOCUMENTS

| | | | |
|---|---|---|---|
| CN | 103855590 | A | 6/2014 |
| CN | 104037586 | A | 9/2014 |
| CN | 108202321 | A | 6/2018 |
| DE | 202011107870 | U1 | 4/2013 |

(Continued)

*Primary Examiner* — A. Dexter Tugbang

(74) *Attorney, Agent, or Firm* — William J. Clemens; Shumaker, Loop & Kendrick, LLP

(57) ABSTRACT

A crimping tool exchange device exchanges a first crimping tool for a second crimping tool, wherein each crimping tool, when at a processing position in a crimping press, produces a crimp connection connecting a conductor end of a cable to a crimp contact. The device includes first and second exchange units retaining the first and second crimping tools respectively. When one of the exchange units is arranged in an exchange position the retained crimping tool can be moved in a first direction between the processing position and the one exchange unit. The first exchange unit is moved linearly from the exchange position in a second direction, and the second exchange unit is moved linearly from the exchange position in a third direction that is different from the second direction, the second direction being at an angle relative to the third direction.

17 Claims, 11 Drawing Sheets

(56) References Cited

FOREIGN PATENT DOCUMENTS

| | | | | |
|---|---|---|---|---|
| EP | 1515403 | A2 | | 3/2005 |
| EP | 1667289 | A1 | | 6/2006 |
| EP | 2738886 | A1 | | 6/2014 |
| EP | 3240123 | A1 | | 1/2017 |
| JP | H0757848 | A | | 3/1995 |
| JP | 2019212570 | A | * | 12/2019 |

* cited by examiner

CRIMPING TOOL EXCHANGE DEVICE

FIELD

The present invention relates to a crimping tool exchange device for exchanging a first crimping tool arranged at a processing position in a crimping press, the first crimping tool producing a crimp connection to connect a conductor end of a cable to a crimp contact, for a second crimping tool, to a crimping press system including the crimping tool exchange device, and to a method for exchanging a first crimping tool, arranged at a processing position in a crimping press, for a second crimping tool.

BACKGROUND

During crimping pressing, the crimping tool and/or the contact roller comprising crimp contacts often has to be exchanged or swapped. For this purpose, the crimping press has to be stopped and the crimping tool and/or the contact roller comprising crimp contacts has to be exchanged, exchanging the contact roller in particular being complex because the contact strip of the contact roller has to be threaded into or out of the crimping tool.

EP 2 738 886 A1 discloses an assembly or a movable feed unit comprising two contact rollers having crimp contacts, and two crimping tools. The movable feed unit comprises wheels, by means of which said unit is rotatable and horizontally displaceable about a vertical axis. The crimping tools and the crimp contact supply are at an angle of 180° relative to one another, i.e. face away from one another. In order to exchange one crimping tool, comprising the contact roller and installed in the crimping press, for another crimping tool, comprising a contact roller, the feed unit has to be rotated about the vertical axis and subsequently aligned again relative to the crimping press.

A disadvantage thereof is that a lot of space is required in order to exchange the crimping tool installed in the crimping press for another crimping tool. Moreover, the exchange is technically complicated, since, after the feed unit has been rotated about the vertical axis, the feed unit needs to be re-aligned with respect to the crimping press. Moreover, the base on which the wheels of the assembly are moved must be very flat.

There may therefore be a need for a crimping tool exchange device and/or a crimping press system and/or a method for exchanging a first crimping tool, arranged at a processing position in a crimping press, for a second crimping tool, which allows for technically simple exchange of one crimping tool installed in the crimping press for another crimping tool, and which requires little space for exchanging the crimping tool installed in the crimping press for another crimping tool.

SUMMARY

According to a first aspect of the present invention, a crimping tool exchange device is proposed, which device is intended for exchanging a first crimping tool, which crimping tool is arranged at a processing position in a crimping press for producing a crimp connection and which tool is intended to connect a conductor end of a cable to a crimp contact, for a second crimping tool, the crimping tool exchange device comprising at least two exchange units for each releasably retaining one crimping tool, the first exchange unit being able to be arranged in an exchange position such that the first crimping tool can be moved, in particular linearly, in a first direction, from the processing position to the first exchange unit, and from the first exchange unit into the processing position, the second exchange unit being able to be arranged in the exchange position such that the second crimping tool can be moved, in particular linearly, in the first direction, from the processing position to the second exchange unit, and from the second exchange unit into the processing position, characterized in that the first exchange unit can be moved linearly from the exchange position in a second direction, and the second exchange unit can be moved linearly from the exchange position in a third direction that is different from the second direction, the second direction being at an angle of less than approximately 150°, in particular less than approximately 100°, preferably less than approximately 90°, relative to the third direction.

An advantage thereof is that the crimping tool exchange device typically requires only a small amount of space or a small volume. In addition, it is usually possible to exchange the first crimping tool for the second crimping tool in a technically particularly simple manner. It is generally not necessary to realign the crimping tool exchange device relative to the crimping press when exchanging the first crimping tool for the second crimping tool. This usually saves time. Moreover, it is typically possible for one crimping tool to be exchanged while the other crimping tool is located in the processing position in the crimping press and the crimping press is operated.

According to a second aspect of the present invention, a crimping press system is proposed, which system comprises a crimping press for producing a crimp connection between a conductor end of a cable and a crimp contact, and the crimping tool exchange device described above, the crimping tool exchange device being rigidly connected to the crimping press in order to exchange a first crimping tool, which crimping tool is arranged in a processing position in the crimping press for connecting the conductor end of the cable to the crimp contact, for a second crimping tool.

An advantage thereof is that the crimping press system typically occupies only a small amount of space. In addition, in the crimping press system, the crimping tool installed in the crimping press can typically be exchanged for a further crimping tool in a manner that is technically simple and quick.

According to a third aspect of the present invention, a method is proposed, which method is intended for exchanging a first crimping tool, arranged at a processing position in a crimping press, for a second crimping tool, using a crimping tool exchange device, the crimping press being designed to produce a crimp connection using the crimping tool that is arranged at the processing position and that connects a conductor end of a cable to a crimp contact, the method comprising the following steps:

- providing the second crimping tool on a second exchange unit of the crimping tool exchange device while the second exchange unit is in a home position;
- providing a first exchange unit of the crimping tool exchange device at an exchange position;
- moving the first crimping tool, in a first direction, from the processing position, onto the first exchange unit of the crimping tool exchange device;
- linearly moving the first exchange unit together with the first crimping tool, in a second direction, away from the exchange position and into a home position;
- linearly moving the second exchange unit together with the second crimping tool, in a third direction, into the exchange position; and moving the second crimping tool, opposite to the first direction, from the second exchange unit and into the processing position; characterized in that the second direction is at an angle of less than approximately 150°, in particular less than approximately 100°, preferably less than approximately 90°, relative to the third direction.

An advantage of this method is that said method can generally be carried out reliably in a manner that is technically particularly simple and that is particularly quick. Moreover, in general only a small amount of space is required to carry out the method.

Concepts for embodiments of the invention may be considered to be based, inter alia, on the concepts and findings described below.

According to one embodiment, the crimping tool exchange device further comprises a spacer element, the spacer element being designed and arranged such that the spacing between the first exchange unit and the second exchange unit, in the second direction and in the third direction, combined, does not fall below a minimum spacing. This typically prevents, in a reliable and technically simple manner, a collision between the two exchange units or a portion of the exchange units while the exchange unit or the exchange units are being moved.

According to one embodiment, the spacer element comprises a chain, the spacer element in particular is a chain, the chain being designed so as to be movable in the second direction and in the third direction. An advantage thereof is that the spacer element is typically designed so as to be cost-effective, sturdy, and technically simple. The minimum spacing is in particular the spacing along the crimping tool exchange device. The minimum spacing is generally the sum of the spacings along the crimping tool exchange device in the second direction and the third direction. In order to prevent the chain from buckling outside the vertex, the chain can be guided and thus kept in a specified path.

According to one embodiment, the first exchange unit and/or the second exchange unit is/are not connected to the spacer element. An advantage thereof is that the exchange units are generally not at a fixed mutual spacing in the second and third direction. The first exchange unit can generally be at a spacing from the second exchange unit that is larger than, in particular significantly larger than, e.g. more than 1.2 times or more than 1.5 times, the minimum spacing. This generally makes it easier to exchange a crimping tool at one of the exchange points for another crimping tool (not installed in the crimping press).

According to one embodiment, the crimping tool exchange device further comprises a first locking device for releasably locking the first crimping tool on the first exchange unit and/or a second locking device for releasably locking the second crimping tool on the second exchange unit. This generally ensures reliable movement of the crimping tool together with the relevant exchange unit. It is typically substantially impossible for the crimping tool to slip relative to the exchange unit while the exchange unit is being moved. This generally makes it easier to exchange a crimping tool at one of the exchange points for another crimping tool (not installed in the crimping press).

According to one embodiment, the crimping tool exchange device can be arranged on a crimping press and the first exchange unit and the second exchange unit can each be moved out of the exchange position to such an extent that, either, one of the two exchange units is arranged within a closed cover of the crimping press and the other of the two exchange units is arranged outside the closed cover of the crimping press, or both exchange units are arranged outside the closed cover of the crimping press. The crimping press can thus generally be operated having a closed cover, while the other exchange unit is accessible from the outside, from outside the cover. The crimping tool (and optionally further components) of the exchange unit that is accessible outside the cover can generally be exchanged, adjusted, threaded out, threaded in, etc. It is thus possible, in general, to reduce the time during which the operation of the crimping press has to be interrupted.

According to one embodiment, each exchange unit further comprises a rod for receiving a contact roller comprising a contact strip and a paper strip, crimp contacts being arranged on the contact strip, immediately successive layers of the crimp contacts being separated by the paper strip, and a paper winder for winding the paper strip when the contact roller is unrolled, it being possible for the contact roller of the first exchange unit to feed crimp contacts to the first crimping tool when the first crimping tool is in the processing position, and for the contact roller of the second exchange unit to feed crimp contacts to the second crimping tool when the second crimping tool is in the processing position. An advantage thereof is that it is generally possible not only to exchange the crimping tool of the relevant exchange unit for another crimping tool (not installed in the crimping press), but it is also possible to exchange the contact roller and/or the crimp contacts together with the crimping tool in a technically simple and quick manner. It is generally possible to thread out/thread in the contact roller or the contact strip on one of the crimping tools (which is located outside the closed cover of the crimping press for example), while the crimping press can use the other crimping tool comprising the contact roller or the contact strip of the other exchange unit. It is thus generally possible to carry out time-consuming work for exchanging the contact roller or the contact strip of one exchange unit while the crimping press continues to be operated (using the other crimping tool and the other contact roller or the other contact strip).

According to one embodiment, the crimping tool exchange device comprises at least one rail in the second direction and at least one rail in the third direction, on which rails the exchange units can be moved. An advantage thereof is that the exchange units can typically be moved in the second direction and/or in the third direction in a technically simple and reliable manner.

According to one embodiment of the method, in each case, when the first exchange unit and/or the second exchange unit is/are moved, a rod for receiving a contact roller comprising a contact strip and a paper strip is also moved, crimp contacts being arranged on the contact strip, immediately successive layers of the crimp contacts being separated by the paper strip, and a paper winder for winding the paper strip when the contact roller is unrolled is also moved. An advantage thereof is that, in general, not only is the crimping tool exchanged, but the contact roller and/or the crimp contacts together with the crimping tool are also exchanged in a technically simple and quick manner. It is thus generally possible to thread out/thread in the contact roller or the contact strip on one crimping tool (which is located outside the closed cover of the crimping press for example), while the crimping press uses the other crimping tool comprising the contact roller or the contact strip of the other exchange unit. It is thus generally possible, using this method, to carry out time-consuming work for exchanging the contact roller or the contact strip while the crimping press continues to be operated (using the other crimping tool and the other contact roller or the other contact strip).

According to an embodiment of said method, the method further comprises the step of: exchanging the first crimping tool for a further crimping tool, in particular exchanging the first crimping tool and the contact roller of the first exchange unit for a further crimping tool and a further contact roller, while the first exchange unit is in the home position. It is thus generally possible to continue to operate the crimping press using one crimping tool while the crimping tool that is no longer required is being exchanged, on the exchange unit, for a further (third) crimping tool. Following this step, the crimping tool currently being used in the crimping press can typically be exchanged, in a technically simple manner, for said (third) crimping tool that is now located on one of the exchange units of the crimping tool exchange device.

According to one embodiment of the method, the steps of linearly moving the first exchange unit together with the first crimping tool, in a second direction, away from the exchange position and into a home position, and linearly moving the second exchange unit together with the second crimping tool, in a third direction, are carried out simultaneously, since a spacer element ensures a minimum spacing between the first exchange unit and the second exchange unit, in the second direction and in the third direction, combined. This generally simplifies the exchange even further, since just one exchange unit needs to be moved into the exchange position. Moving one of the exchange units into the exchange position generally automatically moves the other exchange unit out of the exchange position. This typically reliably prevents the exchange units or a portion of the exchange units from crashing into or striking one another.

It should be noted that some of the possible features and advantages of the invention are described here with reference to different embodiments of the method and/or of the crimping tool exchange device. A person skilled in the art shall recognize that the features may be combined, adapted, or exchanged as appropriate in order to arrive at other embodiments of the invention.

Embodiments of the invention will be described below with reference to the accompanying drawings, neither the drawings nor the description being intended to be interpreted as limiting the invention.

Figure 1:
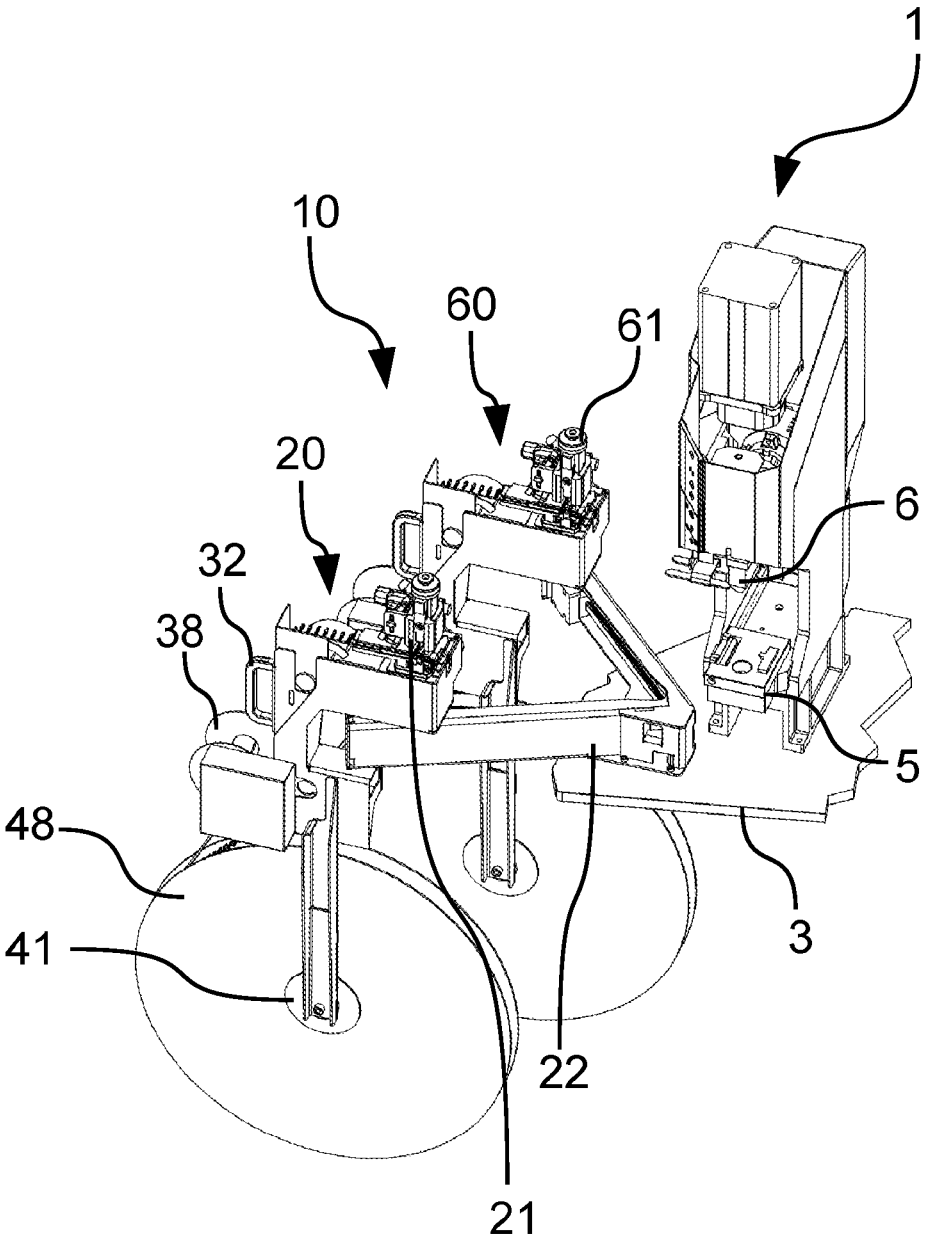
FIG. 1 is a perspective view of an embodiment of the crimping tool exchange device according to the invention, the crimping tool exchange device being mounted on a crimping press, and the two exchange units being in the home position.

The drawings are merely schematic and not true to scale. Like reference signs refer in the drawings to like or analogous features.

DETAILED DESCRIPTION

Figure 2:
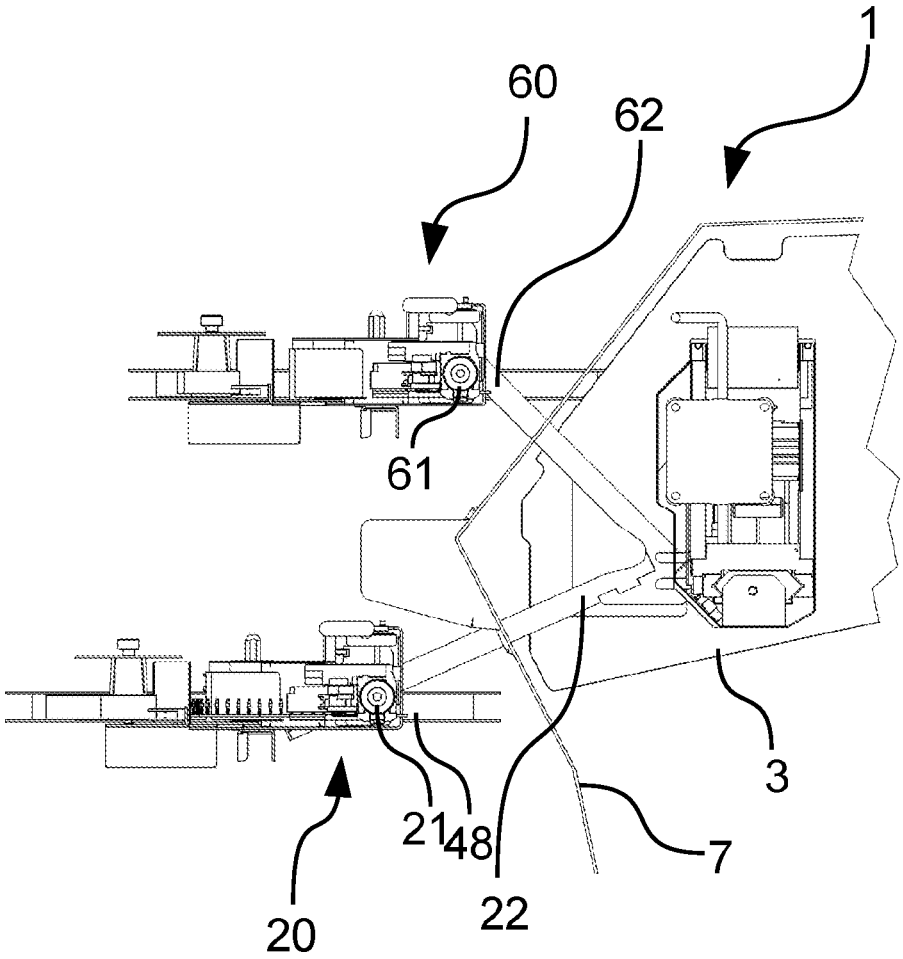
FIG. 2 is a plan view of the crimping tool exchange device from FIG. 1 mounted on the crimping press.
Figure 3:
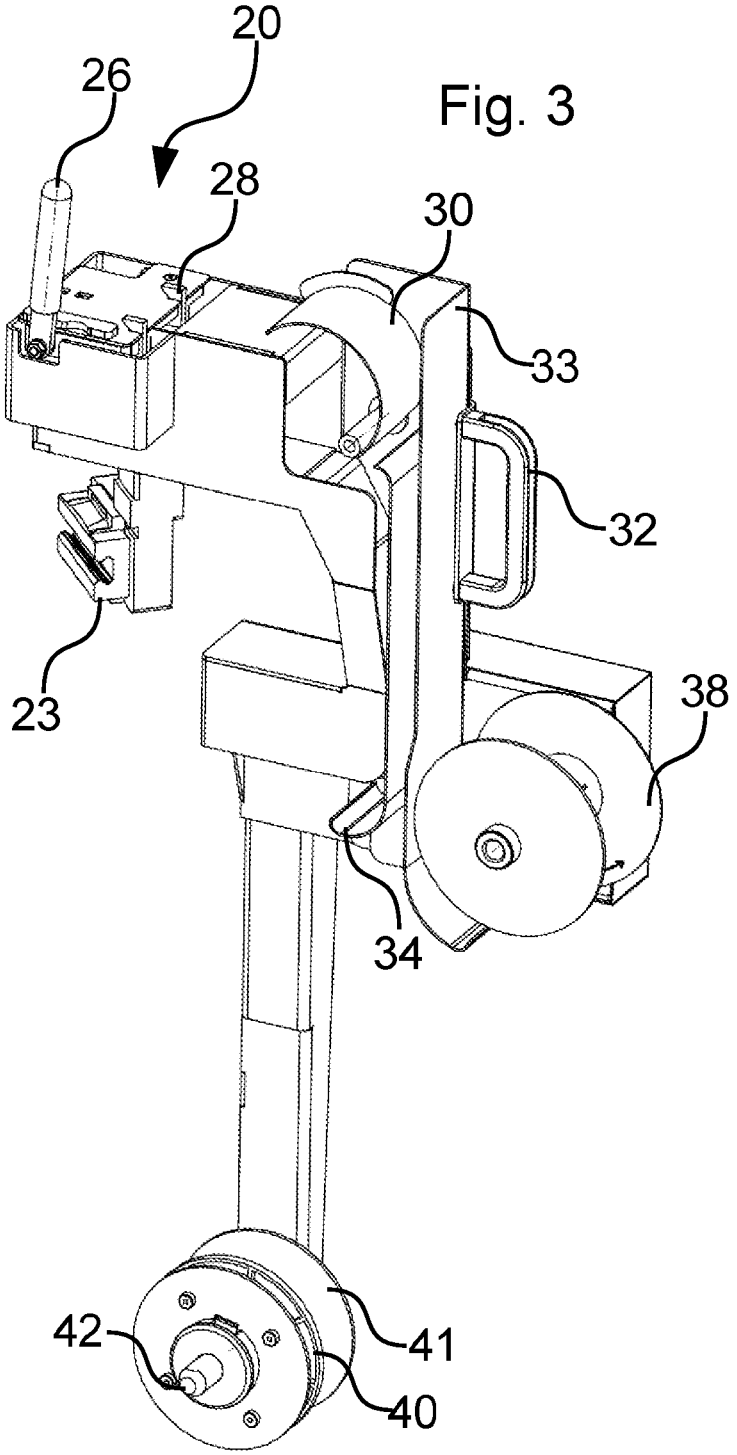
FIG. 3 shows a detail of a first exchange unit of the crimping tool exchange device from FIG. 1 and FIG. 2, without a first crimping tool and without a contact roller.
Figure 4:
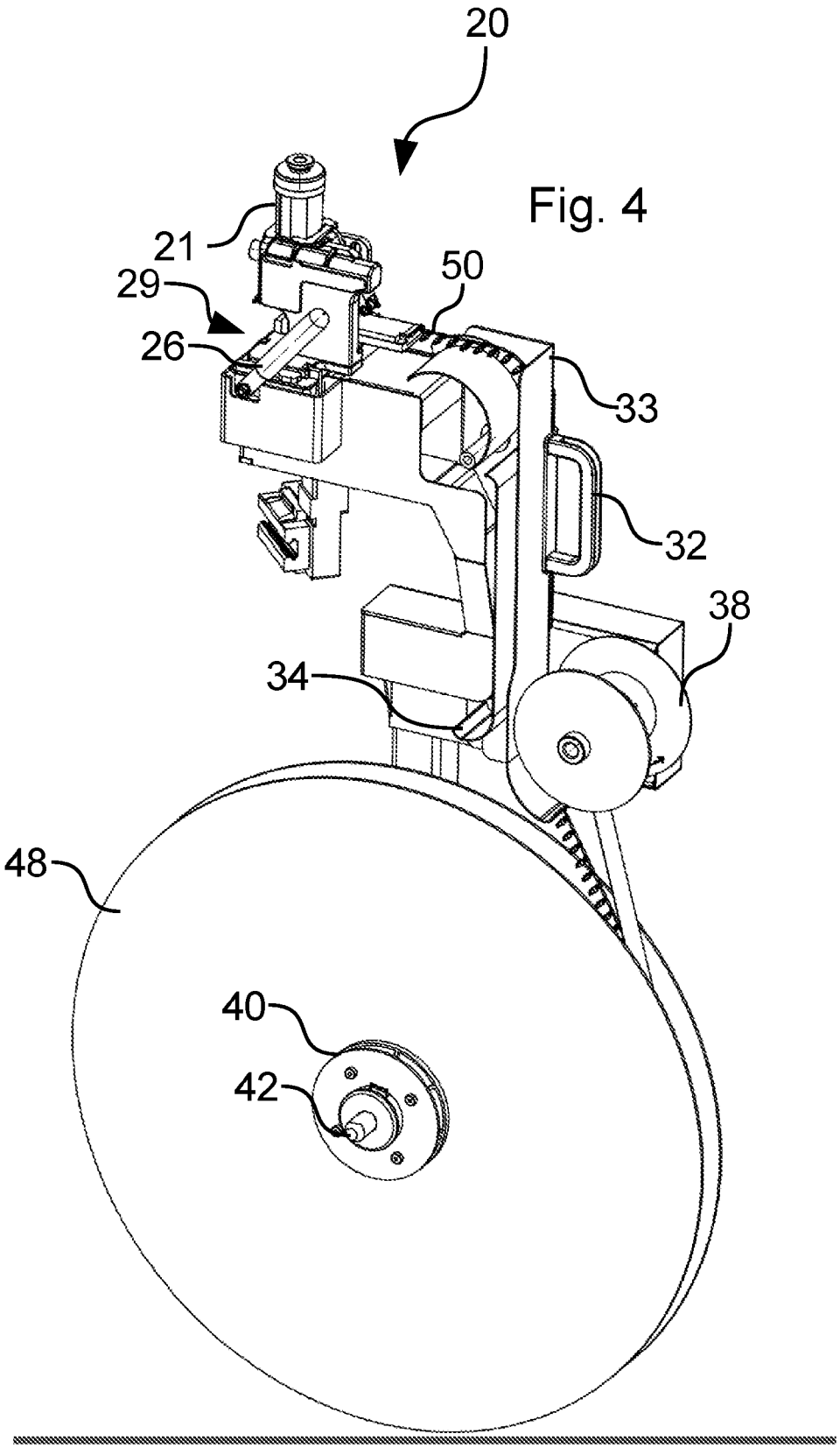
FIG. 4 shows a detail of the first exchange unit from FIG. 3, comprising the first crimping tool and comprising the contact roller.

FIG. 1 is a perspective view of an embodiment of the crimping tool exchange device 10 according to the invention, the crimping tool exchange device 10 being mounted on a crimping press 1, and the two exchange units 20, 60 being arranged in the home position. FIG. 2 is a plan view of the crimping tool exchange device 10 from FIG. 1 mounted on the crimping press 1. FIG. 3 shows a detail of a first exchange unit 20 of the crimping tool exchange device 10 from FIG. 1 and FIG. 2, without a first crimping tool 21 and without a contact roller 48. FIG. 4 shows a detail of the first exchange unit 20 from FIG. 3, comprising the first crimping tool 21 and comprising the contact roller 48.

The crimping tool exchange device 10 is mounted on or rigidly connected to a machine table 3 of the crimping press 1.

The crimping tool exchange device 10 comprises a first exchange unit 20 and a second exchange unit 60. Each of the two exchange units 20, 60 can receive a crimping tool 21, 61. A crimping tool 21, 61 can thus be releasably fastened to each exchange unit 20, 60 and moved together with the exchange unit 20, 60.

The crimping tool exchange device 10 comprises two rails 22, 62 which are arranged so as to be at an angle of more than 0° and less than approximately 150°, in particular of between 0° and approximately 100°, preferably between 0° and approximately 90° relative to one another. The angle can in particular be approximately 80° or approximately 85°. Other angles, for example approximately 60° or approximately 70°, are possible.

Each of the exchange units 20, 60 further comprises:

- a rod 42 for receiving a contact roller 48 comprising a contact strip 50 and a paper strip, crimp contacts being arranged on or fastened to the contact strip 50, immediately successive layers of the crimp contacts being separated by the paper strip,
- at least one guide plate for guiding the contact strip 50 to the crimping tool 21, 61, and
- a paper winder 38 for winding the paper strip when the contact roller 48 is unrolled. Each exchange unit 20, 60 also comprises a movable rocker 30 which makes it possible to control the paper winder 38 and to detect an empty or almost empty contact roller 48.

The paper winder 38 can be mechanically driven and ensures that the contact roller 48 unrolls.

Each exchange unit 20, 60 comprises a fixed clamping jaw 28 and a spring-loaded movable clamping jaw 29 which can be opened and closed by means of a movement of the lever 26, 66. It is thus possible to fasten the relevant crimping tool 21, 61 onto or to the relevant exchange unit 20, 60 such that said tool cannot slip.

The two exchange units 20, 60 may be designed identically.

In FIG. 1, both the exchange units 20, 60 are in a home position. In the home position, the exchange unit 20, 60 is far from the crimping press 1 and/or spaced apart from the crimping press 1.

Figure 5:
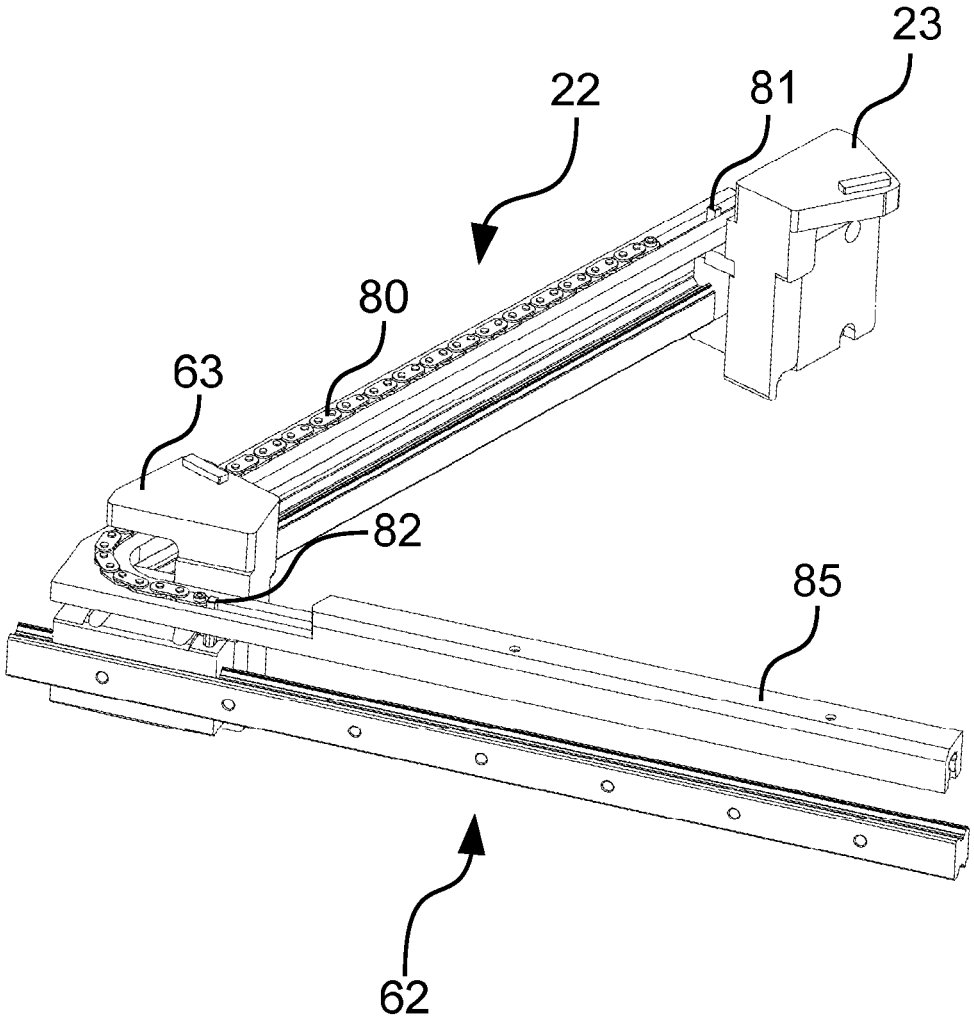
FIG. 5 shows a detail of the rails of the crimping tool exchange device from FIG. 1 and FIG. 2.

FIG. 5 shows a detail of the rails 22, 62 of the crimping tool exchange device 10 from FIG. 1 and FIG. 2.

The first exchange unit 20 comprises a carriage 23 that can be moved along a rail 22 of the crimping tool exchange device 10. The first exchange unit 20 can thus be moved along a rail 22 of the crimping tool exchange device 10, the rail 22 extending in a second direction. The first exchange unit 20 can thus be moved in the second direction (from top left to bottom right in FIG. 2). An end stop prevents the carriage 23 of the first exchange unit 20 from leaving the rail 22 in the direction away from the crimping press 1. The first exchange unit 20 can thus be moved closer to the crimping press 1 and/or the machine table 3 and moved away therefrom again.

The second exchange unit 60 comprises a carriage 63 by means of which the second exchange unit 60 can be moved along a further rail 62. The second exchange unit 60 can be moved along the further rail 62. The further rail 62 extends in a third direction. The second exchange unit 60 can thus be moved in the third direction. An end stop prevents the carriage 63 of the second exchange unit 60 from leaving the further rail 62 in the direction away from the crimping press 1. The second exchange unit 60 can thus be moved closer to the crimping press 1 and/or the machine table 3 and moved away therefrom again.

The two exchange units 20, 60 can thus be moved linearly along a straight line or a line. It is not possible to rotate the relevant exchange unit 20, 60 relative to the rails 22, 62.

The rails 22, 62 form two sides of a triangle. The rails 22, 62 may be of the same length.

The two rails 22, 62 meet at a vertex of the crimping tool exchange device 10. The vertex is what is referred to as the exchange position. If the exchange unit 20, 60 is in the exchange position, i.e. at the vertex of the rails 22, 62, the crimping tool 21, 61 can be moved from the exchange unit 20, 60 and into the processing position or out of the processing position and to the exchange unit 20, 60, i.e. the crimping tool 21, 61 can be installed in the crimping press 1 or can be removed or uninstalled therefrom.

The length of the rails 22, 62 is such that the exchange units 20, 60 can be moved sufficiently far as to be arranged outside the cover 7 of the crimping press 1 in each case. The cover 7 of the crimping press 1 protects the user from touching the crimping press 1 or the crimping tool 21, 61 during operation of the crimping press 1.

In FIG. 5, the second exchange unit 60 is in the exchange position and the first exchange unit 20 is in the home position.

The relevant exchange unit 20, 60 surrounds the relevant rail 22, 62 or a portion thereof. The exchange units 20, 60 can each be moved linearly by means of the linear guide unit in the form of the rails 22, 62.

A spacer element in the form of a chain 80 extends along at least a portion of the rail 22 in the second direction and along at least a portion of the rail 62 in the third direction. The chain 80 extends over the vertex of the crimping tool exchange device 10. The chain 80 extends within a chain guide 85. The chain guide 85 prevents the chain 80 from buckling outside the vertex, such that the chain 80 can transmit a compression force between the exchange units 20, 60. The chain guide 85 additionally protects the user of the crimping tool exchange device 10 from coming into contact with the chain 80. In the drawing in FIG. 5, the chain guide 85 has been omitted in part in order for the chain 80 to be visible. The chain guide 85 extends entirely above the region of the two rails 22, 62 and completely covers said rails. It is also possible, however, for the chain guide 85 to merely guide the chain 80 but not to form a contact guard or touch guard or the like for the chain 80.

Each exchange unit 20, 60 comprises a carrier 81, 82 that extends at the same height as the chain 80. The chain 80 prevents the first exchange unit 20 and the second exchange unit 60 from coming closer than a minimum spacing from one another. The minimum spacing is measured in the second direction and in the third direction. That is to say that the minimum spacing is measured along the course of the chain 80 or the rails 22, 62. The chain 80 encounters the carrier 81, 82 of the relevant exchange unit 20, 60 when the minimum spacing is achieved or should not be met. The length of the chain 80 determines the minimum spacing between the first exchange element and the second exchange element. The minimum spacing between the exchange units 20, 60 is the sum of the distance between the first exchange unit 20 and the vertex and the distance between the second exchange unit 60 and the vertex. In order to prevent the chain 80 from buckling outside the vertex, the chain 80 is guided and retained in a specified path. The path extends along the rails 22, 62, above the vertex.

The spacer element or the chain 80 prevents the two exchange units 20, 60 or a portion thereof (e.g. the contact roller 48, etc.) from touching or from coming too close to one another. This prevents, in a technically simple and reliable manner, a collision between the two exchange units 20, 60 and consequently damage.

If one exchange unit 20, 60 is moved towards the crimping press 1, the other exchange unit 60, 20 (if present at this point) is moved (by the chain 80) out of the exchange position and/or away from the crimping press 1.

The chain 80 is not connected to the first exchange unit 20 or the carrier 81 of the first exchange unit 20. The chain 80 is not connected to the second exchange unit 60 or the carrier 82 of the second exchange unit 60 either. It is thus possible for the two exchange units 20, 60 to be moved away from one another by more than the minimum spacing. Alternatively thereto, the chain 80 can be fastened on or to one or both of the carriers 81, 82. If the chain 80 is fastened to one of the carriers 81, 82, the two exchange units 20, 60 can be moved away from one another by more than the minimum spacing. If the chain 80 is fastened to the two carriers 81, 82, the mutual spacing between the two exchange units 20, 60 along the crimping tool exchange device 10 and/or the course of the chain 80 is specified or fixed.

The spacer element comprises a spacer element that is flexible in shape but rigid in length.

The exchange units 20, 60 each comprise a handle 32, 72 that faces away from the vertex or the crimping press 1. The two exchange units 20, 60 can each be moved, by means of the handle 32, 72, in the second direction (this also includes a movement opposing the second direction) and in the third direction (this also includes a movement opposing the third direction).

The crimping tool exchange device 10 is fastened to the crimping press 1 such that the vertex is close to the crimping press 1. In addition, the crimping tool exchange device 10 is fastened to the crimping press 1 such that the retaining surface of the first exchange unit 20 and of the second exchange unit 60 is at essentially the same height as the lower tool receptacle 5 of the crimping press 1.

The rails 22, 62 extend horizontally. The respective home positions of the exchange units 20, 60 and the exchange position are at the same height.

Figure 6:
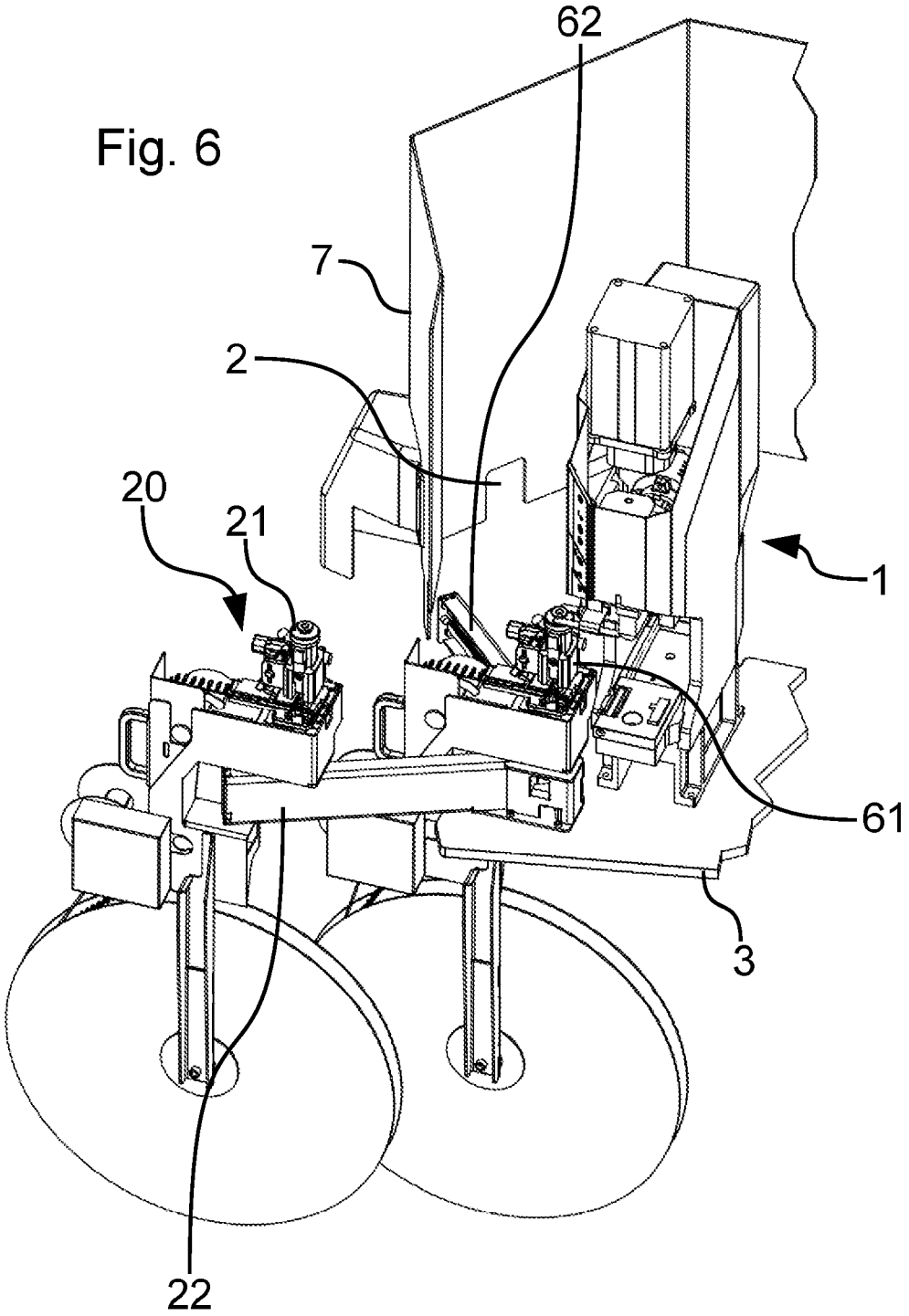
FIG. 6 is a perspective view of the crimping tool exchange device from FIG. 1, the crimping tool exchange device being mounted on a crimping press, and one exchange unit being in the home position and one exchange unit being in the exchange position.
Figure 7:
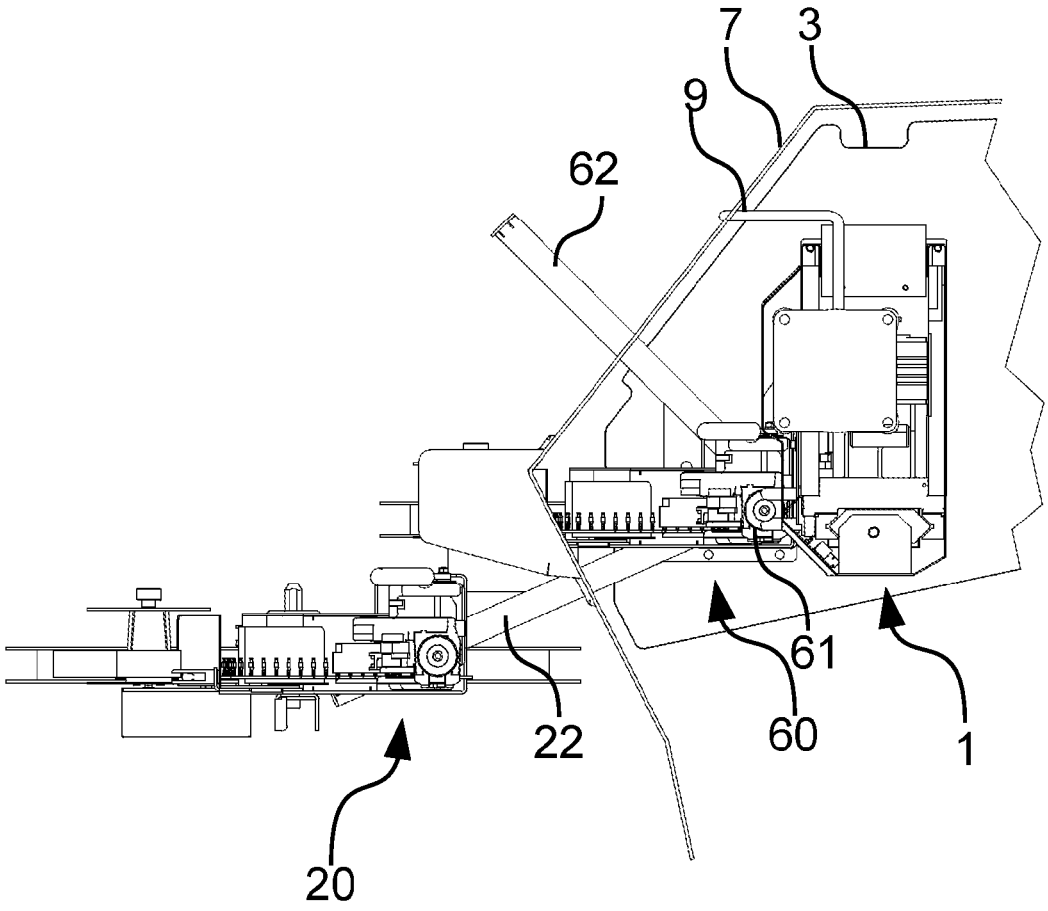
FIG. 7 is a plan view of the crimping tool exchange device from FIG. 6.
Figure 8:
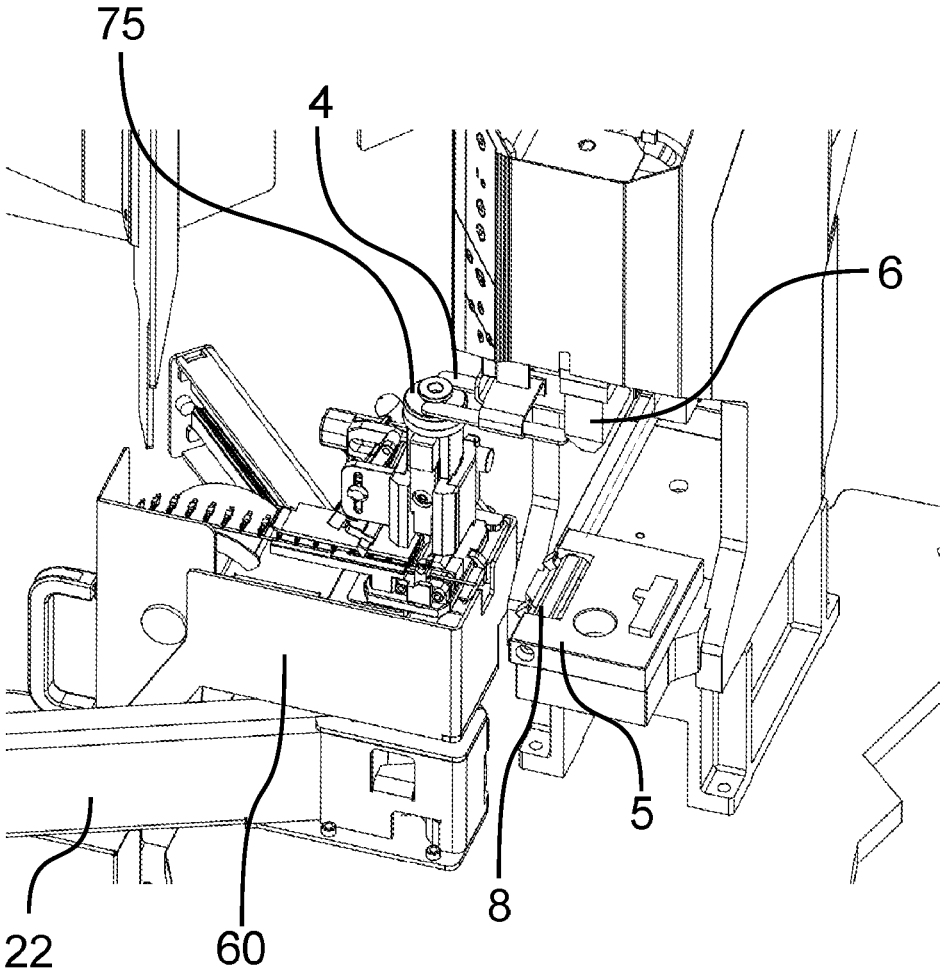
FIG. 8 shows a detail of the crimping tool exchange device from FIG. 6 and FIG. 7.
Figure 9:
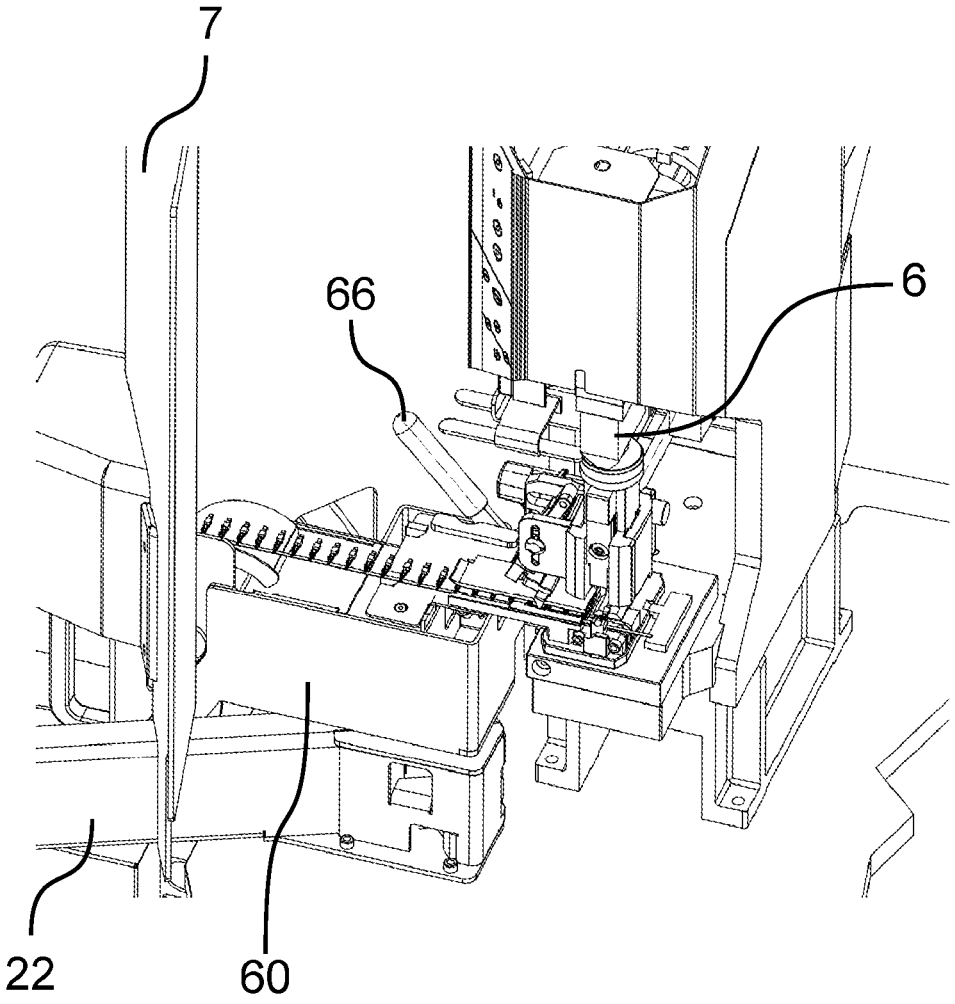
FIG. 9 shows a detail of the crimping tool exchange device from FIG. 6, FIG. 7, and FIG. 8, the second crimping tool being in the processing position.

FIG. 6 is a perspective view of the crimping tool exchange device 10 from FIG. 1, the crimping tool exchange device 10 being mounted on a crimping press 1, and one exchange unit 20, 60 being in the home position and one exchange unit 20, 60 being in the exchange position. FIG. 7 is a plan view of the crimping tool exchange device 10 from FIG. 6. FIG. 8 shows a detail of the crimping tool exchange device 10 from FIG. 6 and FIG. 7. FIG. 9 shows a detail of the crimping tool exchange device 10 from FIG. 6, FIG. 7, and FIG. 8, the second crimping tool 61 being in the processing position.

In FIG. 6, the second exchange unit 60 is in the exchange position, i.e. at the vertex of the two rails 22, 62 of the crimping tool exchange device 10. The first exchange unit 20 is in the home position, i.e. spaced apart from the crimping press 1. The position of the second exchange unit 60 is such that, when the cover 7 of the crimping press 1 is closed, the second exchange unit 60 is located within the closed cover 7 of the crimping press 1. The first exchange unit 20 is located outside the cover 7 of the crimping press 1. The cover 7 of the crimping press 1 comprises a recess 2, for feeding crimp contacts of the relevant exchange unit 20, 60, located in the exchange position, to the crimping tool 21, 61 in the processing position.

Work can be carried out on the first exchange unit 20 while the crimping press 1 is operated (using the second crimping tool 61), since the first exchange unit 20 is located outside the cover 7 of the crimping press 1. In particular, the crimping tool 21 can be exchanged or swapped and/or the contact roller 48 and/or the contact strip 50 can be exchanged. For this purpose, the contact strip 50 can be threaded out of the guide plates 33, 34 of the first exchange unit 20 and the paper winder 38. The contact roller 48 can subsequently be removed. Another contact roller 48 can be inserted onto the rod 42, the resilient flange 40 and the fixed flange 41 of the first exchange unit 20. The contact strip 50 can also be introduced or threaded into the guide plates 33, 34 of the first exchange unit 20 and guided to the crimping tool 21. The paper strip can also be guided into the paper winder 38. It is thus possible for all work for exchanging the crimping tool 21 of the first exchange unit 20 and/or the contact roller 48 of the first exchange unit 20 (including threading in and threading out the contact strip 50 or the paper strip, winding an already unrolled contact strip 50, together with the paper strip, back onto the contact roller 48, detaching and disposing of excess paper strips, releasing the fastening of the contact roller 48, etc.) to be carried out while the crimping press 1 is operated using the second crimping tool 61.

The same of course also applies in reverse in the case of a correspondingly reversed arrangement of the two exchange units 20, 60, i.e. the second crimping tool 61 and the contact roller of the second exchange unit 60 can be exchanged (in the home position of the second exchange unit 60) while the crimping press 1 is operated using the first crimping tool 21.

Interruptions of operation of the crimping press 1 can therefore be kept short.

It is of course also possible to exchange both crimping tools 21, 61 (and the associated contact rollers 48) at the same time, when the crimping press 1 is not being operated.

Proceeding from the position shown in FIG. 6, FIG. 7, and FIG. 8, the second crimping tool 61 can be pushed and/or lifted by hand or manually, in a first direction (from left to right in FIG. 7), away from the crimping tool exchange device 10 or away from the second exchange unit 60. FIG. 9 shows the second crimping tool 61 after said movement and after the cover 7 has been closed. Prior thereto, the lever 66 of the second exchange unit 60 is moved into the release state in order to release the locking or fastening of the second crimping tool 61 to the second exchange unit 60.

An upper constriction of the ram 75 of the second crimping tool 61 is introduced into an insertion aid 4 of the crimping press 1. When the second crimping tool 61 is moved (to the right in FIG. 7), the ram 75 thus enters the upper tool receptacle 6 of the crimping press 1. At the same time, the contact strip is unrolled slightly further from the contact roller, since the contact strip is fastened to the crimping tool 61 or is connected thereto.

Subsequently, the second crimping tool 61 or the lower portion of the second crimping tool 61 is fixed or mounted in the crimping press 1 by means of a clamping device 8. The clamping device 8 can be moved into a clamping position and into a release position by means of a lever 9. The second crimping tool 61 is now in the processing position. Thereupon, the cover 7 of the crimping press 1 is closed. The crimping press 1 is now ready for operation using the second crimping tool 61. During crimping, the contact roller 48 of the exchange unit 20, 60 located in the exchange position supplies crimp contacts to the crimping tool 21, 61 arranged in the processing position.

In order to remove the crimping tool 21, 61 from the processing position, the operation of the crimping press 1 is interrupted or stopped, the cover 7 of the crimping press 1 is opened, and the clamping device 8 of the crimping press 1 is released. The crimping tool 21, 61 can now be moved (in the first direction or in a direction opposing the first direction) towards the exchange unit 20, 60 and can be locked there by the clamping jaws 28, 29. The exchange unit 20, 60 can now be moved together with the crimping tool 21, 61 without it being possible for the crimping tool 21, 61 to slip relative to the exchange unit 20, 60.

Figure 10:
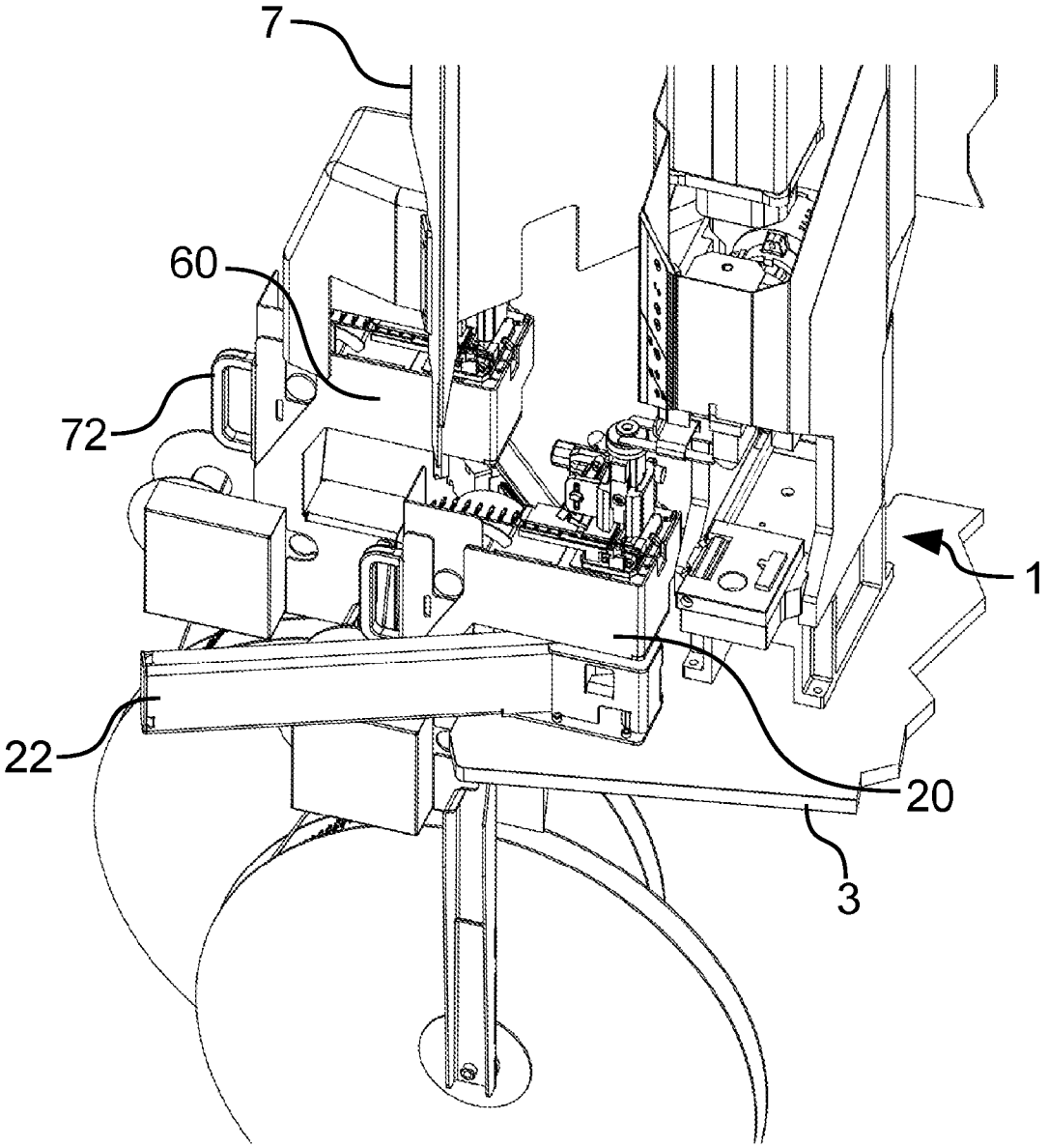
FIG. 10 is a perspective view of the crimping tool exchange device from FIG. 1, the first exchange unit being arranged in the exchange position.
Figure 11:
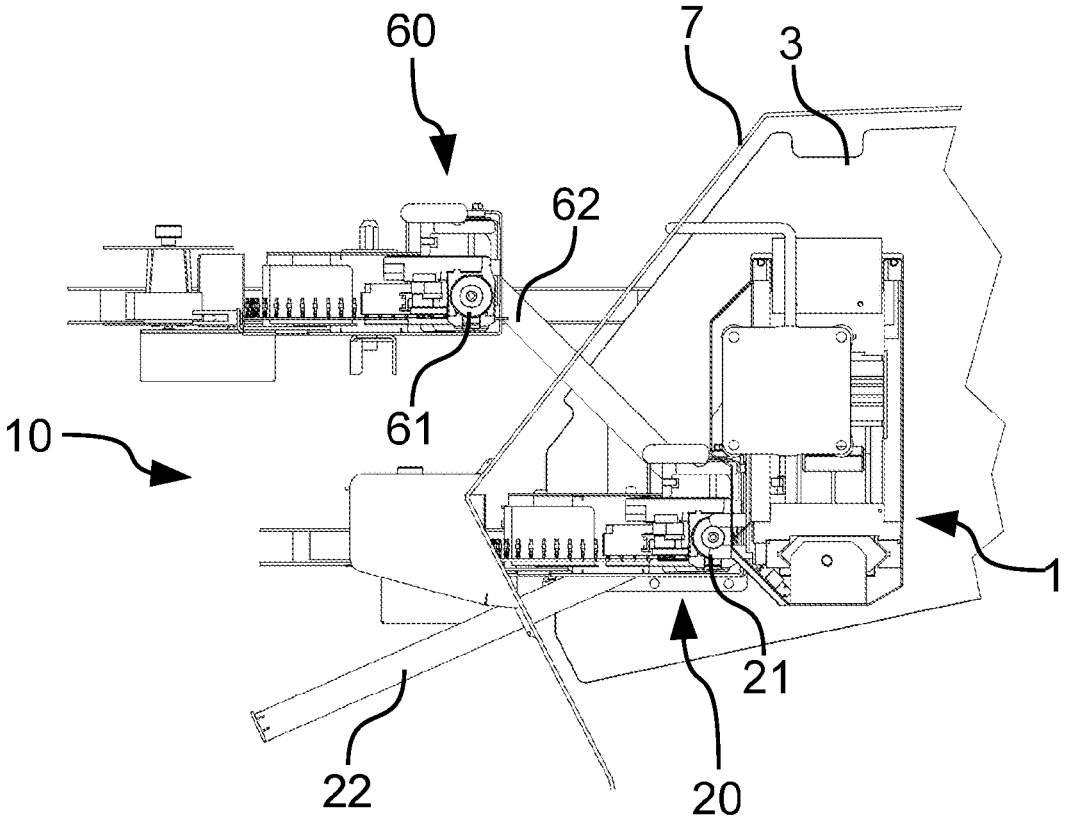
FIG. 11 is a plan view of the crimping tool exchange device from FIG. 10.

FIG. 10 is a perspective view of the crimping tool exchange device 10 from FIG. 1, the first exchange unit 20 being arranged in the exchange position. FIG. 11 is a plan view of the crimping tool exchange device 10 from FIG. 10. In FIG. 10 and FIG. 11, the first exchange unit 20 is in the exchange position. The second exchange unit 60 is in the home position. The first crimping tool 21 can now be installed in the crimping press 1, i.e. moved into the processing position, in the manner described for the second crimping tool 61 in connection with FIG. 6-9. The crimping tool 61 and/or the contact roller of the second exchange unit 60 can be exchanged while the crimping press 1 uses the first crimping tool 21.

The apex angle or the angle between the second direction and the third direction is in a horizontal plane or is measured in such a plane.

Finally, it should be noted that terms such as "comprising", "having" etc. do not preclude other elements or steps and terms such as "a/an" or "one" do not preclude a plurality.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A crimping tool exchange device for exchanging a first crimping tool, the first crimping tool being arranged at a processing position in a crimping press for producing a crimp connection to connect a conductor end of a cable to a crimp contact, for a second crimping tool comprising:

a first exchange unit for releasably retaining the first crimping tool and a second exchange unit for releasably retaining the second crimping tool;

the first exchange unit being movable to an exchange position at which the first crimping tool can be moved in a first direction from the processing position in the crimping press to the first exchange unit and moved from the first exchange unit into the processing position opposite the first direction;

the second exchange unit being movable to the exchange position at which the second crimping tool can be moved in the first direction from the processing position in the crimping press to the second exchange unit and moved from the second exchange unit into the processing position opposite the first direction;

wherein the first exchange unit is arranged to move linearly from the exchange position in a straight line second direction, and the second exchange unit is arranged to move linearly from the exchange position in a straight line third direction that is different from the straight line second direction; and wherein the straight line second direction and the straight line third direction meet at the exchange position and the straight line second direction is at an angle of less than 150° relative to the straight line third direction.

2. The crimping tool exchange device according to claim 1 including a spacer element for preventing a spacing between the first exchange unit and the second exchange unit from falling below a minimum spacing, the spacing being a sum of a distance of the first exchange unit from the exchange position in the straight line second direction and a distance of the second exchange unit from the exchange position in the straight line third direction.

3. The crimping tool exchange device according to claim 2 wherein the spacer element includes a chain movable in the straight line second direction and in the straight line third direction.

4. The crimping tool exchange device according to claim 2 wherein at least one of the first exchange unit and the second exchange unit is not connected to the spacer element.

5. The crimping tool exchange device according to claim 1 including at least one locking device for releasably locking at least one of the first crimping tool on the first exchange unit and the second crimping tool on the second exchange unit.

6. The crimping tool exchange device according to claim 1 wherein the crimping press has a cover movable into a closed position and wherein the crimping tool exchange device is arranged on the crimping press and each of the first exchange unit and the second exchange unit is movable out of the exchange position whereby one of the first and second exchange units is positioned within the cover in the closed position and another of the first and second exchange units is positioned outside the closed cover, or both of the first and second exchange units are positioned outside the closed cover.

7. The crimping tool exchange device according to claim 1 wherein each of the first and second exchange units includes a rod for receiving a contact roller including a contact strip and a paper strip wound on the contact roller, a plurality of crimp contacts being arranged on the contact strip, immediately successive layers of the crimp contacts being separated by the paper strip, and each of the first and second exchange units includes a paper winder for winding the paper strip when the contact roller is unrolled, wherein, when the first crimping tool is in the processing position, the contact roller of the first exchange unit feeds the crimp contacts to the first crimping tool, and wherein, when the second crimping tool is in the processing position, the contact roller of the second exchange unit feeds the crimp contacts to the second crimping tool.

8. The crimping tool exchange device according to claim 1 including at least one rail extending in the straight line second direction and at least one rail extending in the straight line third direction, and the first and second exchange units are movable along respective ones of the rails.

9. A crimping press system comprising:

a crimping press for producing a crimp connection between a conductor end of a cable and a crimp contact at a processing position;

a crimping tool exchange device for exchanging a first crimping tool, the first crimping tool being arranged at a processing position in a crimping press for producing a crimp connection to connect a conductor end of a cable to a crimp contact, for a second crimping tool;

the crimping tool exchange device including a first exchange unit for releasably retaining the first crimping tool and a second exchange unit for releasably retaining the second crimping tool, the first exchange unit being movable to an exchange position at which the first crimping tool can be moved in a first direction from the processing position in the crimping press to the first exchange unit and moved from the first exchange unit into the processing position opposite the first direction, the second exchange unit being movable to the exchange position at which the second crimping tool can be moved in the first direction from the processing position in the crimping press to the second exchange unit and moved from the second exchange unit into the processing position opposite the first direction;

wherein the first exchange unit is arranged to move linearly from the exchange position in a straight line second direction, and the second exchange unit is arranged to move linearly from the exchange position in a straight line third direction that is different from the straight line second direction;

wherein the straight line second direction and the straight line third direction meet at the exchange position and the straight line second direction is at an angle of less than 150° relative to the straight line third direction; and wherein the crimping tool exchange device is rigidly connected to the crimping press to enable an exchange of the first crimping tool, arranged at the processing position in the crimping press, for the second crimping tool.

10. A method for exchanging a first crimping tool, arranged at a processing position in a crimping press, for a second crimping tool, the crimping press producing a crimp connection using a one of the first and second crimping tools arranged at the processing position by connecting a conductor end of a cable to a crimp contact, the method comprising the following steps:

providing a crimping tool exchange device having a first exchange unit for releasably retaining the first crimping tool and a second exchange unit for releasably retaining the second crimping tool;

the first exchange unit being movable to an exchange position at which the first crimping tool can be moved in a first direction from the processing position in the crimping press to the first exchange unit and moved from the first exchange unit into the processing position opposite the first direction, the second exchange unit being movable to the exchange position at which the second crimping tool can be moved in the first direction from the processing position in the crimping press to the second exchange unit and moved from the second exchange unit into the processing position opposite the first direction;

wherein the first exchange unit is arranged to move linearly from the exchange position in a straight line second direction, and the second exchange unit is arranged to move linearly from the exchange position in a straight line third direction that is different from the straight line second direction;

wherein the straight line second direction and the straight line third direction meet at the exchange position;

providing the second exchange unit with the second crimping tool while the second exchange unit is at a home position of the second exchange unit;

providing the first exchange unit at the exchange position;

moving the first crimping tool, in the first direction, from the processing position onto the first exchange unit;

linearly moving the first exchange unit together with the first crimping tool, in the straight line second direction, away from the exchange position and into a home position of the first exchange unit;

linearly moving the second exchange unit together with the second crimping tool, in the straight line third direction, into the exchange position; and moving the second crimping tool, in the first direction, from the second exchange unit into the processing position, wherein the straight line second direction is at an angle of less than 150° relative to the straight line third direction.

11. The method according to claim 10 wherein each of the first exchange unit and the second exchange unit includes a rod for receiving a contact roller including a contact strip and a paper strip wound on the contact roller, a plurality of crimp contacts being arranged on the contact strip with immediately successive layers of the crimp contacts being separated by the paper strip, and a paper winder for winding the paper strip when the contact roller is unrolled, and including moving the rods of the first and second exchange units and the paper winders when the first and second exchange units are moved between the exchange position and the home positions.

12. The method according to claim 11 including exchanging the first crimping tool and the contact roller of the first exchange unit for a further crimping tool and a further contact roller while the first exchange unit is in the home position.

13. The method according to claim 10 including linearly moving the first exchange unit together with the first crimping tool, in the straight line second direction, away from the exchange position and into the home position and simultaneously linearly moving the second exchange unit together with the second crimping tool, in the straight line third direction, into the exchange position, and using a spacer element to prevent a spacing between the first exchange unit and the second exchange unit from falling below a minimum spacing, the spacing being a sum of a distance of the first exchange unit from the exchange position in the straight line second direction and a distance of the second exchange unit from the exchange position in the straight line third direction.

14. The method according to claim 10 including providing the home position of at least one the first exchange unit and the second exchange unit located outside a cover of the crimping press.

15. A crimping tool exchange device for exchanging a first crimping tool, the first crimping tool being arranged at a processing position in a crimping press for producing a crimp connection to connect a conductor end of a cable to a crimp contact, for a second crimping tool comprising:

a first exchange unit for releasably retaining the first crimping tool and a second exchange unit for releasably retaining the second crimping tool;

the first exchange unit being movable to an exchange position at which the first crimping tool can be moved in a first direction from the processing position in the crimping press to the first exchange unit and moved from the first exchange unit into the processing position opposite the first direction;

the second exchange unit being movable to the exchange position at which the second crimping tool can be moved in the first direction from the processing position in the crimping press to the second exchange unit and moved from the second exchange unit into the processing position opposite the first direction;

wherein the first exchange unit is arranged to move linearly from the exchange position in a straight line second direction, the second exchange unit is arranged to move linearly from the exchange position in a straight line third direction that is different from the second direction, and the straight line second direction is at an angle of less than 150° relative to the straight line third direction; and a rail extending in the straight line second direction along which the first exchange unit moves and another rail extending in the straight line third direction along which the second exchange unit moves.

16. A crimping tool exchange device for exchanging a first crimping tool, the first crimping tool being arranged at a processing position in a crimping press for producing a crimp connection to connect a conductor end of a cable to a crimp contact, for a second crimping tool comprising:

a first exchange unit for releasably retaining the first crimping tool and a second exchange unit for releasably retaining the second crimping tool;

the first exchange unit being movable to an exchange position at which the first crimping tool can be moved in a first direction from the processing position in the crimping press to the first exchange unit and moved from the first exchange unit into the processing position opposite the first direction;

the second exchange unit being movable to the exchange position at which the second crimping tool can be moved in the first direction from the processing position in the crimping press to the second exchange unit and moved from the second exchange unit into the processing position opposite the first direction;

wherein the first exchange unit is arranged to move linearly from the exchange position in a straight line second direction, and the second exchange unit is arranged to move linearly from the exchange position in a straight line third direction that is different from the straight line second direction; and wherein the straight line second direction is at an angle of less than 150° relative to the straight line third direction, and wherein the straight line second direction and the straight line third direction meet at the exchange position and including a spacer element for preventing a spacing between the first exchange unit and the second exchange unit from falling below a minimum spacing, the spacing being a sum of a distance of the first exchange unit from the exchange position in the straight line second direction and a distance of the second exchange unit from the exchange position in the straight line third direction.

17. A crimping tool exchange device for exchanging a first crimping tool, the first crimping tool being arranged at a processing position in a crimping press for producing a crimp connection to connect a conductor end of a cable to a crimp contact, for a second crimping tool comprising:

a first exchange unit for releasably retaining the first crimping tool and a second exchange unit for releasably retaining the second crimping tool;

the first exchange unit being movable to an exchange position at which the first crimping tool can be moved in a first direction from the processing position in the crimping press to the first exchange unit and moved from the first exchange unit into the processing position opposite the first direction;

the second exchange unit being movable to the exchange position at which the second crimping tool can be moved in the first direction from the processing position in the crimping press to the second exchange unit and moved from the second exchange unit into the processing position opposite the first direction;

wherein the first exchange unit is arranged to move linearly from the exchange position in a straight line second direction, and the second exchange unit is arranged to move linearly from the exchange position in a straight line third direction that is different from the straight line second direction; and wherein the straight line second direction is at an angle of less than 150° relative to the straight line third direction, and wherein the crimping press has a cover movable into a closed position and wherein the crimping tool exchange device is arranged on the crimping press and each of the first exchange unit and the second exchange unit is movable out of the exchange position whereby one of the first and second exchange units is positioned within the cover in the closed position and another of the first and second exchange units is positioned outside the closed cover, or both of the first and second exchange units are positioned outside the closed cover.

* * * * *